United States Patent [19]

Hawkins, Sr. et al.

[11] Patent Number: 4,989,876

[45] Date of Patent: Feb. 5, 1991

[54] PRACTICE GOLF CLUB AND SYSTEM

[76] Inventors: Arnold R. Hawkins, Sr., 1487 Sixth Ave., San Francisco, Calif. 94122; Arnold R. Hawkins, Jr., 2437 Williams Ct. So., San Francisco, Calif. 94080

[21] Appl. No.: 273,215

[22] Filed: Nov. 18, 1988

Related U.S. Application Data

[63] Continuation-in-part of Ser. No. 128,032, Dec. 3, 1987, abandoned, which is a continuation-in-part of Ser. No. 11,677, Feb. 6, 1987, abandoned.

[51] Int. Cl.[5] ..... A63B 69/36

[52] U.S. Cl. ..... 273/176 F; 273/181 F; 273/193 R; 273/194 A; 273/199 R; 273/DIG. 20; 273/186 A

[58] Field of Search ..... 273/186 R, 186 A, 186 B, 273/186 C, 186 D, 186 E, 175, 193 R, 193 A, 193 B, 194 R, 194 A, 194 B, 181 F, DIG. 20, 199 R, 176 F, 176 B, 176 R

[56] References Cited

U.S. PATENT DOCUMENTS

| | | | |
|---|---|---|---|
| 976,267 | 11/1910 | Knight | 273/80 B |
| 1,338,963 | 5/1920 | Rolfe | 273/176 F |
| 1,524,196 | 1/1925 | Matthews | 273/193 A |
| 1,524,731 | 2/1925 | Davis | 273/175 |
| 1,536,616 | 5/1925 | Manning | 273/175 |
| 2,462,955 | 3/1949 | Glancey | 273/35 |
| 2,464,850 | 3/1949 | Crawshaw | 273/80 |
| 2,660,436 | 11/1953 | Grossman | 273/77 |
| 2,753,599 | 7/1956 | Pietraszek et al. | 18/47.5 |
| 3,101,949 | 8/1963 | Williams | 273/186 |
| 3,194,564 | 7/1965 | Swan | 273/186 A |
| 3,231,281 | 1/1966 | Wallo | 273/193 |
| 3,256,023 | 6/1966 | Frazelle | 273/165 |
| 3,317,211 | 5/1967 | Debski | 273/186 |
| 3,351,346 | 11/1967 | Strahan | 273/193 |
| 3,384,376 | 5/1968 | Greenlee | 273/193 R |
| 3,424,464 | 1/1969 | Greenhouse | 273/178 |
| 3,468,538 | 9/1969 | Johnson | 273/68 |
| 3,743,297 | 7/1973 | Dennis | 273/193 A |
| 3,754,764 | 8/1973 | Manheck | 273/186 D |
| 3,771,788 | 11/1973 | Hurley et al. | 273/68 |
| 3,791,654 | 2/1974 | Lupinacci | 273/186 A |
| 3,897,068 | 7/1975 | Staples | 273/193 R |
| 3,986,719 | 10/1976 | Lee | 273/181 F |
| 3,992,013 | 11/1976 | Golden | 273/186 D |
| 4,139,198 | 2/1979 | Kanavas | 273/186 A |
| 4,479,653 | 10/1984 | Woodson | 273/186 A |
| 4,603,862 | 8/1986 | Chen | 273/183 C |
| 4,776,594 | 10/1988 | Rango | 273/164 |
| 4,790,534 | 12/1988 | Jamison | 273/DIG. 20 |

OTHER PUBLICATIONS

"The Golfworks" 1988 Holiday Issue Catalog, pp. 16–24, Ralph Maltby Enterprises, Inc., Newark, Ohio 43055–7199.

*Primary Examiner*—George J. Marlo
*Attorney, Agent, or Firm*—T. Gene Dillahunty

[57] ABSTRACT

This invention discloses a system for improving ones golf game by using a practice club with a very small head to hit practice balls that are light weight and preferably are very small in diameter. The novel practice golf club has a head or ball-hitting surface which is much smaller than a conventional golf club, such as either surface having a width of about 3.5 cm (1.4 in.) or less or even about 1.5 cm (0.6 in.) or less or a convex surface having a radius of less than about 1.25 cm (0.5 in.) or even about 0.8 cm (0.3 in.) or less. The practice balls are much lighter and preferably smaller than a conventional golf ball, such as less than about 30 g, for example about 1.9 cm (0.75 in.) in diameter and about 1.5 g or about 1.27 cm (0.5 in.) in diameter and about 1 g. This invention includes as optional components of the system mat means and net means. The invention can be embodied in the form of an adaptor to convert a conventional golf club to have the type of ball-hitting surface described above.

46 Claims, 3 Drawing Sheets

PRACTICE GOLF CLUB AND SYSTEM

RELATED APPLICATIONS

This application is a continuation in part of application Ser. No. 07/128,032 filed Dec. 3, 1987, now abandoned, which is a continuation in part of application Ser. No. 07/011,677 filed Feb. 6, 1987, now abandoned.

FIELD OF THE INVENTION

This invention relates to practice golf apparatus for improving a player's golf game performance.

BACKGROUND OF THE INVENTION

There have been an abundance of devices and systems proposed and used in the past for golf training or golf practice. These various devices and systems each use a different approach or basis on which they are intended to improve a player's golf game performance. In general the previous devices and systems can be grouped into at least three categories. In one category are the practice clubs which are used to practice one's swing, but are not used to hit balls. These practice clubs include practice clubs which are weighted much heavier than the normal golf club and intended to build up the player's muscles. Such clubs are either weighted so the entire club is heavier than the normal club, or are weighted so they are heavier in the club head. Also in this category, weights are applied to a normal club to make the head heavier than normal. These clubs are used to strengthen the player's muscles and for other purposes. Other clubs of various weights and weight distribution in this category are tied, tethered or attached to a stationary object to force the player to swing the practice club through a set pattern or path, presumed to be a correct swing for actual play. The distinguishing feature of this category of practice clubs is that they are not used to actually hit a ball. Even the standard club to which a weight is attached to the club head is not used to hit a ball while the excess weight is attached.

A second category of devices and systems for golf practice are those used by a player who practices with his or her regular golf clubs hitting regular golf balls. Conventional golf clubs are approximately 89 to 109 cm (about 35 to 43 in.) in length and weigh approximately 283 to 454 g (about 10 to 16 oz.). The conventional golf ball weighs no more than about 45.9 g (1.62 oz.) and has a maximum diameter of 4.27 cm (1.68 in.). The devices and systems for use with standard golf clubs and golf balls include various nets, nets with targets, mats for teeing up the ball, various guides for position of the feet, for club path or for body position, impact decals, powders or detectors for showing where on the club head face the ball was hit, and others.

A third category of golf practice devices or systems are those for use when the player uses his or her regular golf club to hit a regular size but light weight ball, such as a whiffle ball, foam or sponge ball, foam or sponge ball with a weight embedded in the foam. Also in this category is a device with a "ball" on the end of a lever which swivels about a pin attached to a mat or base when the player hits the "ball" with a standard golf club.

The above types of golf practice devices and systems provide varying degrees of improvement and/or frustration for the player trying to improve his or her golf game through practice. However, there remains a need for and a great desire for a golf practice device system which will more reliably improve a player's golf game, which will do so in a shorter amount of time spent practicing and which will provide the improvement with less physical stress on the player's body and with less mental stress or frustration.

THE INVENTION

This invention is based on the surprising discovery made through trial and error and proven through testing, that a player can substantially improve his or her golf game by practicing hitting light weight, preferably small diameter, balls with a practice club which has a head or ball-hitting surface which is much smaller than a conventional golf club. In one preferred and optimum form, this invention provides surprising improvement in a player's game when the player practices by hitting a hollow plastic practice ball, which has a diameter of about 1.9 cm (0.75 in.) and weighs about 1.5 g, with a practice club which, instead of a head, has a ball-hitting area which is at the lower end of the shaft and is about 1.25 cm (0.5 in.) in diameter, where the practice club is comparable in length and weight to a conventional golf club.

This surprising discovery on which the apparatus and system of this invention is based, is directly contrary to previous belief that in order to improve ones golf game one should practice with the actual clubs and balls which would be used in the regular gold game. Consequently, this invention is embodied in new and unique practice golf clubs, combinations of practice golf clubs and practice balls, and other embodiments described herein. In addition to improving the golf player's game performance, this invention provides various other advantages and benefits to the player, as described herein.

Having set forth above the concept on which this invention is based and an example of an optimum embodiment of the invention, applicants now set forth the various broader aspects of this invention. Thus, in one aspect this invention is a practice golf club comprising a shaft, grip means at the upper portion of the shaft, and the lower end of the shaft comprises either (a) a club head which is substantially smaller than a conventional golf club head, such as no more than about 3.5 cm (1.4 in.) in horizontal width across the face of the club head which is adapted for contacting the ball or (b) a small curved surface area on the side thereof adapted for hitting a ball, such as where the portion of said surface which is adapted for contacting the ball is convex and has a radius in at least one plane of no more than about 1.25 cm (0.5 in.). In this aspect of the invention, the practice club can be comparable in length and weight to a standard golf club, but the club face width can be smaller than 3.5 cm (1.4 in.), such as about 1.5 cm (0.6 in.) or less, and the radius of the convex surface can be smaller than 1.25 cm (0.5 in.), such as about 0.8 cm (0.3 in.) or less.

In another aspect this invention is a golf practice system comprising in combination, a practice golf club and a practice ball wherein the practice golf club is as described in the preceding paragraph and the practice ball is no larger than a standard golf ball, which is about 4.3 cm (1.69 in.) in diameter, but is substantially lighter in weight than a standard golf ball, such as one having a weight of less than about 30 g. In this aspect the practice ball can also be smaller as well as lighter than a regular golf ball, for example about 2.5 cm (1 in.) or less in diameter and about 10 g or less in weight.

In another aspect this invention is a kit of parts for a golf practice system comprising, a practice golf club as described above and a practice ball as described above.

In another aspect this invention is an adaptor for converting the face of a conventional golf club to a club face having either of the characteristics (a) or (b) described above, i.e., where the adapter comprises a surface area in the central portion thereof adapted for hitting a ball wherein the portion of said surface which is adapted for contacting the ball is either (a) a surface or face which is no more than about 3.5 cm (1.4 in.) in horizontal width across the face or (b) a convex surface which has a radius in at least one plane of less than about 1.25 cm (0.5 in.) and where the adaptor further comprises means for attaching the adaptor to the face of a conventional golf club head whereby the adaptor surface can be used to hit a practice ball described above.

In another aspect this invention is a kit of parts comprising an adaptor as described in the preceding paragraph and a practice ball as described above.

The above golf practice systems or kits of parts of this invention can optionally include either a mat off of which the balls are hit, or a net into which the balls are hit, or can include both.

DESCRIPTION OF THE INVENTION AND EMBODIMENTS THEREOF

Figure 1A:
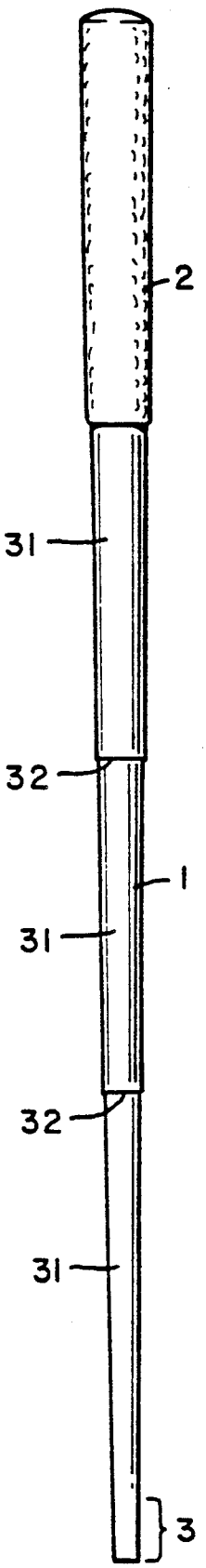
FIGS. 1*a*, 1*b* and 1*c* show preferred embodiments of the practice golf club of this invention, namely where the ball-hitting surface at the lower portion on the club is the cylindrical end portion of the practice golf club shaft.

This invention has been resulted from and is based on an approach to golf practice which is contrary to prior approaches, including those referred to above in the background description. The approach taken in this invention is to practice for your golf game using a practice golf club which is approximately standard length and weight but has a very small head or area on the end of the shaft with which to hit a ball and using that practice club to hit very small, light weight practice balls. The result of this unconventional approach could be analogized to taking the sweet spot from a regular golf club, i.e., without the rest of the club or club face which normally surrounds the sweet spot of the club, and using that bare sweet spot to practice hitting small, light weight balls. It would not have been expected that this approach would improve your golf game.

The theory on which this approach was based, was that if a player could learn, through practice, to consistently hit the small ball with the small, the sweet spot-sized head face or hitting surface on the practice club, then that player would find it comparatively easy to consistently hit a regular size golf ball with the sweet spot of a regular golf club. Trials and tests have proven that this theory is correct and this approach to golf training and practice is very effective. For example, using a practice club, on which the ball hitting surface is the lower end portion of a 1.27 cm (0.5 in.) diameter practice club shaft, to hit practice balls which are either 1.9 cm (0.75 in.) or 1.27 cm (0.5 in.) in diameter, it has been found that the player's golf game improved significantly. It has been found that it is not necessary to learn to hit the small practice balls straight every time or even a high percentage of the time in order to show significant improvement in the player's golf game. It has been observed that merely learning to hit even a small percentage of the small practice balls in any reasonable forward direction is a sufficient learning of skills to provide a significant improvement in the player's actual golf game. But, as the player practices more and is able to hit a higher percentage of the small practice balls in the desired manner, the player's golf game will improve even more. It has been found also that when the player has not practiced with the practice club and small practice balls of this invention for some period of time, such as a week or more, then it can take a half an hour or more of practice before the player can hit the small practice balls with any degree of proficiency approaching what the player could achieve before. After resharpening of these skills, the player's golf game again improves.

One surprising aspect of this invention is that there is apparently no problem associated with the transition from the practice club of this invention to a regular club and back to the practice club. To the contrary, the additional or more finely tuned skills learned hitting these small practice balls with this practice club are directly transferable to the regular golf club and regular golf ball. There is no mental or other transition that needs to be made. The player practices with the practice club and practice balls according to this invention, then can play an actual golf game immediately without noticing the need for any significant changes or adjustments. It has been found that best results are achieved from the system of this invention when the player practices regularly with this practice golf club and these practice balls, and it is especially important to practice with the system of this invention just before each round of golf that is played.

This invention provides a number of benefits and advantages for the golfer. One major benefit is the reduction of physical stress on the golfer while practicing. When using a regular golf club and a regular golf ball, if the ball is not hit almost exactly with the sweet spot of the club head, the off-center forces generated are transmitted through the golf club to the player's hands, arms and shoulders. Also, divot strokes or swings or swings with a regular golf club while practicing or playing produce additional physical stresses on the golfer, at least partly because of the club head being cantilevered from the club shaft. This invention essentially eliminates those physical stresses on the golfer during practice. Hitting the small, light weight practice ball of this invention does not generate any significant shock forces that are transmitted through the practice club, so the golfer does not feel any jarring or other forces using the practice golf club and practice balls of this invention, even when the ball is hit off center. In addition, due to the practice club of this invention having a very small head or nor head, the stresses and shock from divot strokes or swings are also minimized. In one preferred aspect of this invention, the practice club, or at least the end portion of the practice club, can be made so flexible that it will not transmit to the player's hands or arms the shock generated by a divot stroke or swing. Even though the practice club is very flexible in such an embodiment, the practice club still functions as desired, because the small, light weight practice balls can be hit as usual with the flexible practice club, which does not bend or deflect when it hits just the small, light weight practice ball. This flexible club embodiment is particularly preferred by players who have had an injury or are injured and must avoid putting any stress on the present or former injury, such as the stress caused by a divot stroke or swing. This is also a preferred type of practice club for children. As mentioned below, the stresses from divot strokes or swings can be further minimized by using a mat with the practice club and practice balls. It should be noted that "divot" normally means the piece of earth displaced when a golf club is swung too low under a golf ball, but the term "divot" is used herein to indicate a golf club swing or stroke which is low and causes the end of the club to hit or contact the surface on which the ball is positioned.

As a result of reducing or eliminating physical stresses during practice, this invention enables the golfer to use longer practice sessions or to practice more often without increasing risk of injury or aggravating an existing injury. In addition, a golfer with a minor injury can practice with the practice club and practice balls of this invention without unduly aggravating the injury because of divot swings.

Other advantages and benefits afforded the golfer by this invention will be apparent. They include improved game performance due to being able to practice more and/or practice longer, increased confidence due to hitting more consistently on the sweet spot of the regular club, longer and straighter drives due to that confidence, as well as other advantages which will be realized by each golfer as he or she uses the system of this invention. Since the golf practice system of this invention can be used at home or wherever the golfer wants to practice, this invention also provides a significant saving in time and expense that need not be expended going to and from driving ranges or golf courses merely for practice sessions.

Having described the basis and fundamental aspects of this invention, as well as some advantages and benefits thereof, we now describe the implementation and embodiment of this invention in the form of the particular practice club, the practice balls and the optional mat and net.

Figure 1B:
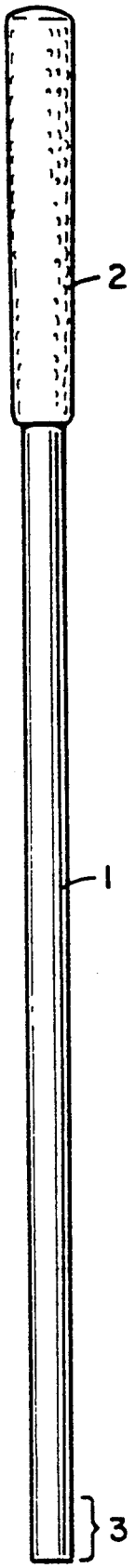
Figure 1C:
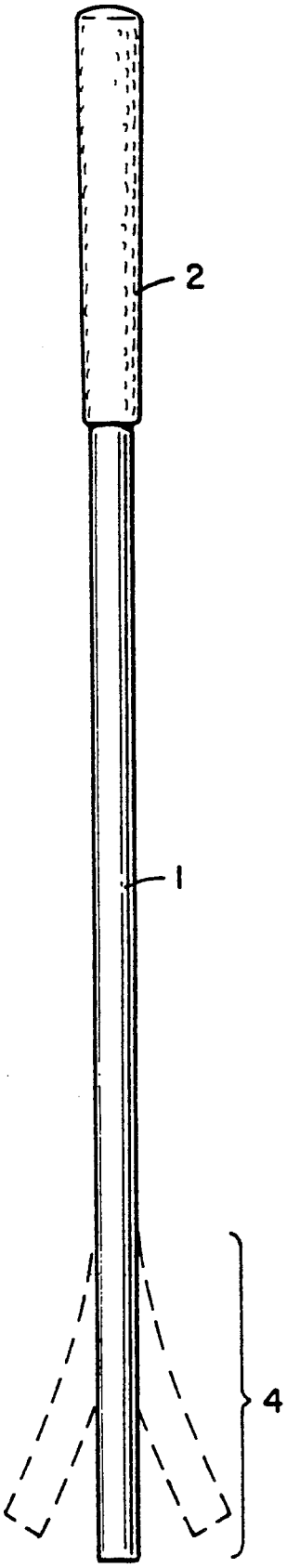

The practice golf club of this invention has as its essential feature the small surface area available at the lower end of the club for hitting practice balls. A preferred configuration for the ball-hitting surface is a convex shape and preferably has a radius in at least one plane of no more than about 1.25 cm (0.5 in.). It is more preferred that the radius be no more than about 1 cm and most preferably that it be no more than about 0.8 cm (0.3 in.) The convex shape can be any desired configuration, such as cylindric, spheric, eliptic, parabolic or other convex shape found to be effective following the disclosure of the invention herein. The convex shape can be smooth or can be a series of planar or other type surfaces which together form the convex surface, in which case the radius referred to herein is the average radius of the curvature of the surface. As illustrated in FIG. 1*a*, the practice golf club of this invention comprises shaft 1 and grip 2 at the upper portion of the shaft. At the lower portion of the shaft is ball-hitting surface area 3. In this preferred embodiment, the ball-hitting surface area is merely an extension of or is the end portion of the practice club shaft itself. The shaft of the practice golf club of this invention can be tapered, as illustrated in FIG. 1*a*, or can be constant diameter, as illustrated in FIG. 1*b*. The constant diameter shaft configuration may have certain manufacturing and economic advantages. The performance of the practice golf club of this invention having the constant diameter configuration is believed to be essentially the same as a tapered shaft practice golf club according to this invention. FIG. 1*c* illustrates an embodiment of the practice golf club having a flexible end 4 as described above. The club of FIG. 1*c*, as well as other embodiments of this invention, can be tapered as in FIG. 1*a* or straight as in FIG. 1*b*. Also shown in FIG. 1*a* is an optional feature wherein shaft sections 31 can either telescope, fold or disconnect at joints 32 to provide means for compact storage or transport of the practice golf club of this invention.

Figure 2:
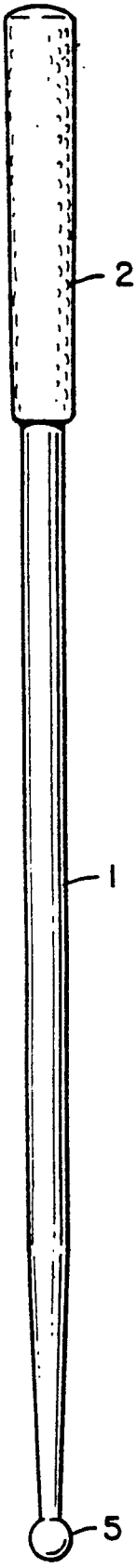
FIG 2. shows an embodiment of the practice golf club of this invention where the ball-hitting surface is spherical in shape.
Figure 3:
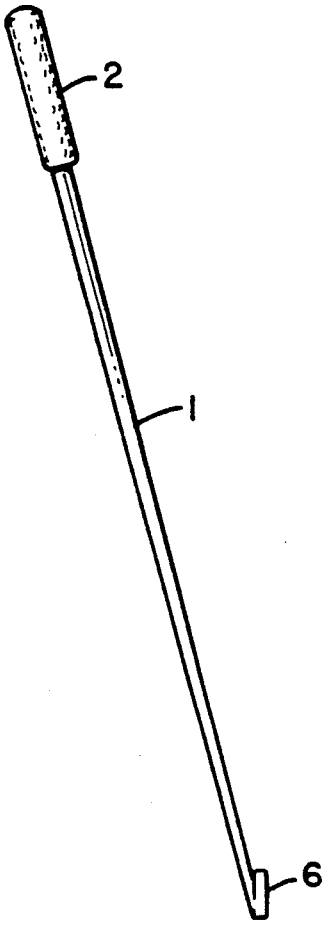
FIG. 3 shows an embodiment of the practice golf club of this invention where the ball-hitting surface is a vertical cylindrical shape.

FIG. 2 illustrates an embodiment wherein the ball-hitting surface 5 is a sphere having a radius of about 1.25 cm (0.5 in.) or less. FIG. 3 illustrates an embodiment wherein the ball-hitting surface 6 is a cylindrical shape which is substantially vertical when the ball is hit.

Figure 4A:
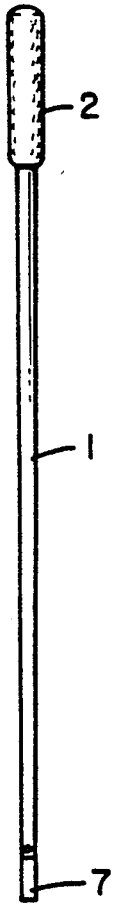
FIG. 4*a* shows the front view and FIG. 4*b* shows the side view of an embodiment of the practice golf club of this invention where the ball-hitting surface is a narrow flat surface.
Figure 4B:
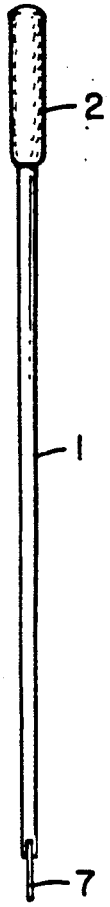

Alternatively, the ball-hitting surface at the lower portion of the shaft may be a flat surface 7 as illustrated by the embodiment in front view FIG. 4*a* and side view FIG. 4*b*. The surface can also be any other desired configuration which is found to be effective and in conformance with the description of this invention. For example, the surface can be a hexagonal or other polygon shaped face, or can be any other desired shape. In regard to this alternative embodiment form of the practice golf club of this invention, the essential feature thereof is that the width of the ball-hitting surface or face, perferrably the horizontal width thereof, as presented to the ball, should be no more than about 3.5 cm (1.4 in.), preferably no more than about 3 cm (1.2 in.), more preferably no more than about 2.5 cm (1 in.), even more preferably no more than about 2 cm (0.8 in.) and most preferably only about 1.5 cm (0.6 in.) or less. The height of the ball-hitting surface or face is not considered as important as the width, but it is generally preferred that the height be comensurate or proportional to the width, whether the surface or face is square, round, rectangular or other shape. It is the width of the ball-hitting surface that is viewed by the player looking down on the practice club as he or she practices with the club and it is that aspect of the hitting surface that the player is addressing the ball with.

It is a desirable feature of the practice golf club of this invention that the club have a length and a total weight comparable to a standard club a player would normally use in actual play. For example it is generally desirable for the practice golf club of this invention to correspond in length and weight to a wood or driver which a player normally uses. Thus, the practice golf club of this invention will normally range in length from about 84 or 85 cm (33 or 34 in.) (or shorter for childrens' models) to about 124 or 125 cm (about 49 in.). The total weight will range from about 280 g (10 oz.)(or less for childrens' models) to about 455 g (16 oz.). It is not particularly important for the overall center of gravity of the practice golf club of this invention to correspond to the position of the center of gravity of a standard golf club. It has been found that it is more important to have the total weight of the practice golf club of this invention correspond to the total weight of a standard club normally used by the player in actual play, than it is to match the center of gravity. However, it is usually desirable to have the center of gravity of the practice golf club of this invention within about 25 or 30 cm (10 or 12 in.) of the center of gravity of a standard club, and preferably within about 20 cm (8 in.).

The total weight and the center of gravity of the practice golf club of this invention can be achieved and adjusted or changed in any desired or conventional manner. For example, the material and configuration of the shaft can be fashioned to provide the desired weight and center of gravity, or, when a hollow shaft is used, the cavity therein can be filled at the desired regions with lead or other material to provide the desired total weight and desired center of gravity of the practice club.

A preferred practice golf club according to this invention has been made of pultruded polyester fiber glass reinforced tube with an o.d. of 1.27 cm (0.5 in.) and an i.d. of 0.76 cm (0.3 in.). The tube is cut to the desired length, fitted with a conventional golf grip at the upper end, a sufficient length lead rod secured inside the lower end of the tube to give the club the desired total weight and the end sealed to hold the lead rod in place and prevent it from coming out of the end of the practice club during use. Other materials may be used to provide the club with any particular set of properties or characteristics which may be desired by a particular player using the practice golf club of this invention. It is generally preferred to use a light or white color, because it provides good visual observation of the end of the club by the user. In some cases the materials used for shaft construction in standard or conventional golf clubs will be suitable for use in the practice golf club of this invention, provided that the club can be weighted and the center of gravity adjusted to the weight and feel desired by the user of the practice golf club.

The primary essential feature of the practice ball component of the practice system and combination of this invention is that it be substantially lighter than a conventional golf ball. For example, the practice ball of this invention should weight no more than about 3.0 g, preferably no more than about 20 g and more preferably no more than about 10 g. In a most preferred embodiment the practice ball will weigh less than about 5 g. The second essential feature of the practice ball of this invention is that it be no larger than a standard golf ball (about 4.3 cm diam.) (1.68 in.) and preferably have a diameter no larger than about 3.2 cm (1.25 in.), more preferably no larger than about 2.5 cm (1 in.) and most preferably no larger than about 2 cm (0.8 in.). It has been found that one optimum size and weight for the practice ball component of this invention is a diameter of about 1.9 cm (0.7 in.) and less than about 3 g, such as about 1.5 g. Another optimum diameter and weight is about 1.25 cm (0.5 in.) and about 1 g.

The material used to make the practice balls of this invention can be any desired material to give the above practice balls other properties or characteristics desired by the user. The balls may be foam, solid plastic, hollow plastic, wood, fabric, etc. One material which is especially preferred for the practice balls is low density polyethylene (LDPE). Practice balls, which are hollow, LDPE, 1.9 cm (0.75 in.) diameter and 1.5 g, and when used with the above 1.27 cm (0.5 in.) o.d. pultruded polyester fiber glass practice golf club, give a desirable "crack" sound when the balls are hit with the practice club. This sound roughly simulates the characteristic sound of a correctly hit standard golf ball when hit with a standard club and provides the player with additional input of sensory perception during practice, which enhances the learning process that takes place as a result of practicing with the practice club and practice ball system of this invention.

The sound and the speed of flight of the practice ball when hit with the practice golf club is due at least in part to the density and resilience of the ball and the type of material the ball is made of. If the ball is too hard, i.e., the material of the ball is too brittle, the ball will move so fast when hit that it is difficult for the player to see or determine the direction the ball went. Such balls are also more prone to breaking or shattering when hit repeatedly, or some times only once, during practice. Some high density polyethylene (HDPE) materials are in this category. The more resilient the balls and materials are, the less likely the balls are to break or shatter. Plus, the more resilient balls move slower when hit, which enables the player to better determine the direction, altitude and flight pattern of the practice ball each time it is hit with the practice club. If the balls are too soft, such as soft foam, they may not provide the player with a feed back of all the aspects of practice the player desires, but they may be acceptable for use by beginners or by children.

Figure 5:
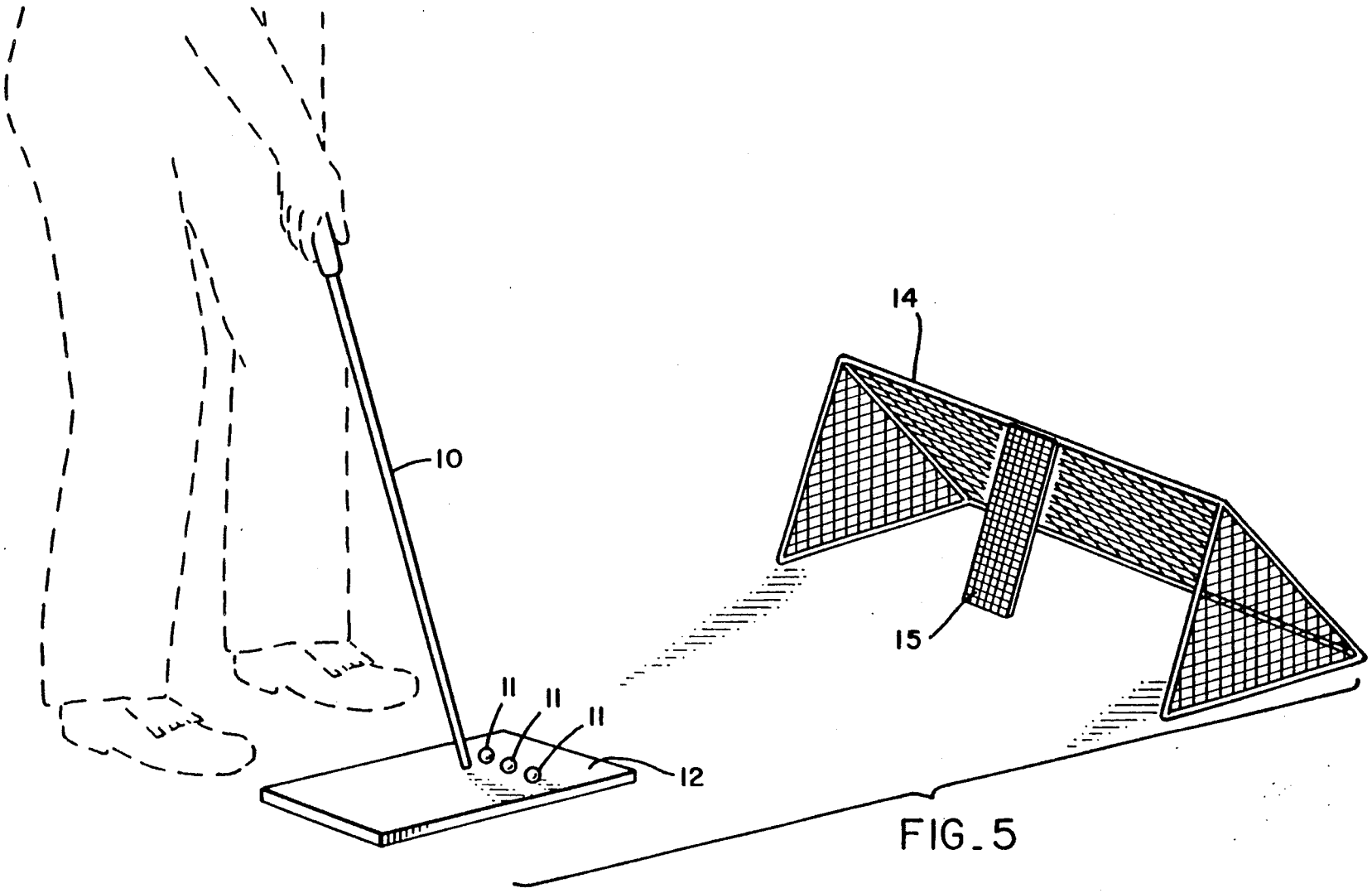
FIG. 5 shows an embodiment of the combination of the practice golf club and the practice ball according to this invention and further shows the preferred optional mat means and net means.

As illustrated in FIG. 5, it is preferred to use the system of the practice golf club 10 and practice balls 11 of this invention with a practice mat 12 and/or a practice net 14. The mat is especially useful in helping to reduce or eliminate the stress on the golfer caused by divot strokes or swings that occur while practicing. The mat can be made of any material which provides the properties or characteristics desired. To help reduce or eliminate shock and vibration from divot strokes or swings, the mat can have a soft or energy absorbing base, such as form rubber or corrugated cardboard. The mat can be made like a brush with the bristles of a desired length extending upward from a base. This type of mat will support the practice balls on top of the bristles, which need not be very strong because the practice balls can be very light weight. In this configuration, when the player makes a divot stroke or swing with the practice club, the end of the club merely passes through the brush bristles without hitting anything solid. This provides a practice system in which the player can be completely uninhibited in swinging the practice club, because no shock or vibration will be felt in the club, even if the swing is low, under the ball and through the bristles. This can aid the golfer in working on a new stroke or swing patterns or styles, and can be very important to the injured golfer who wants to continue practice but cannot risk encountering any stress and potential re-injury from a divot stroke.

Another useful function of the mat is to reduce or eliminate the wear and tear on the end of the practice golf club which occurs from divot-type strokes. Preferred materials for the top of the mat include nylon, polypropylene, wool, and other low friction materials like Teflon (trademark of DuPont). Good, low cost mats can be made from the indoor/outdoor carpets or artificial grass mats, such as the Astroturf brand (trademark of Monsanto) mat products.

Another useful function of the mat is to provide the desired height for the practice balls, i.e., to simulate the height of a teed-up ball. While the mat can include tee means for holding a practice ball above the surface of the mat, it is generally preferred to just place the practice balls on the surface of the mat and hit them off the mat surface with the practice golf club. Thus, the mat can be of sufficient thickness to elevate the practice balls to a height similar to the height a ball would be on a tee. As with the transition from the practice club and practice balls of this invention to regular golf clubs and regular golf balls, the transition from hitting practice balls off the surface of a mat with a practice club of this invention to hitting regular golf balls off tees or off the ground with regular golf clubs is essentially unnoticed. The improved skills provided by this invention makes tee shots and fairway shots easier for the player without any conscious mental or other adjustment on the part of the player.

Another useful function the mat can provide is means for visual patterns, guides or colors on the surface of the mat. The mat may have any desired pattern or markings on the surface to provide any desired aid to the golfer in his or her practice. For example, a regular grid of squares or lines at right angles can be of benefit to some golfers. For others, a series of colored, spaced apart lines having decreasing lengths as they near the position of the practice ball that is to be hit may be of benefit. Others may find that color patterns or color strips, e.g., alone or in the grid pattern, are helpful. Such patterns or colors can diagram for the golfer the approach path for the club and the follow-through line or path the club should follow.

The mat may be any size desired by the golfer. It is generally useful to have the mat cover enough area to assure that all divot strikes will be on the mat. It is also usually desirable to have the mat large enough to accommodate lining up a dozen or more of the small, light weight practice balls according to this invention, so they can be hit one by one in order down the line with the practice golf club of this invention. This can enable the golfer to hit a larger number of practice balls in a given length of practice session or work-out.

The practice net 14 illustrated in FIG. 5 can be of any desired size, particularly if its primary function is to just catch the practice balls. However, if the net is sized appropriately, it can also assist in providing training information to the player regarding how well the player is hitting the practice balls. If the net is made relatively small, additional incentive is provided for the player to hit the practice balls correctly. It is not a problem when the practice balls of this invention miss the net, because the preferred small, light weight practice balls of this invention do not travel very far even when hit well, and they rarely do damage to anything they may strike, since they are small and light weight.

One preferred size for the net is about 65 cm (25.5 in.) high and about 165 cm (65 in.) wide supported on a triangular frame as illustrated in FIG. 5. As advantage of the small size net for use in this invention is that it can be disassembled into a compact form suitable for carrying while travelling. A feature of the net 14 which can be added if desired is a vertical target strip 15 for the golfer to strive to hit with the practice balls. The materials of construction of the net are preferably light weight to enhance the compactness and portability of the net when disassembled. Very light weight frame and net materials are useful in this invention because the preferred practice balls are small and very light weight, such as 1 or 2 grams. For example, the net frame can be conventional PVC pipe and the net material can be sun screen mesh fabric.

Figure 6A:
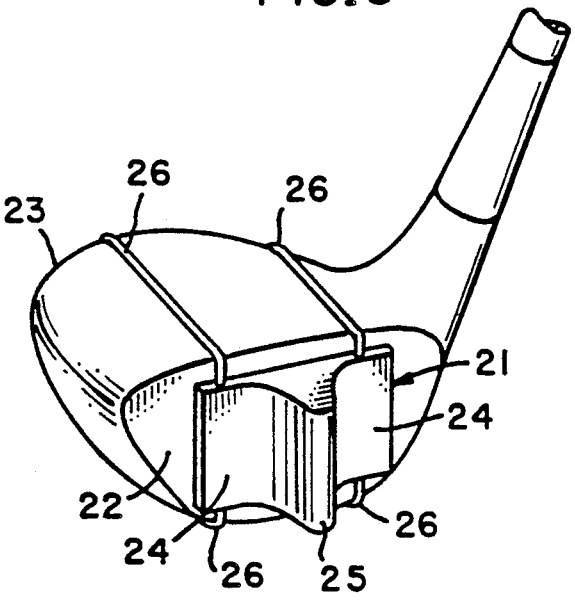
FIG. 6*a* shows a perspective view and FIG. 6*b* shows a top view of an embodiment of this invention in the form of an adaptor for a conventional golf club adapted to convert the regular club face to a shape having the characteristics of the practice golf club of this invention.
Figure 6B:
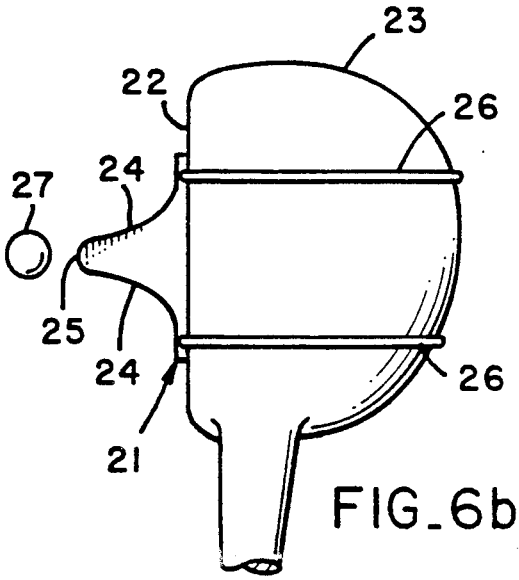

FIGS. 6*a* and 6*b* are a perspective view and a plan view, respectively, of the embodiment of this invention comprising an adaptor for a conventional golf club to convert the standard club to a practice golf club in accordance with this invention. The adaptor can have may suitable ball hitting surface shape, as described herein for the practice golf club. One embodiment of such an adaptor is illustrated in FIG. 6 wherein the adaptor 21 is designed to fit on the face 22 of a conventional golf club head 23. The sides 24 of the adaptor are sloped or curved to deflect away the practice balls that are not hit properly on the ball hitting surface area 25. The point area 25 of the adaptor is a convex ball-hitting surface having a radius less than about 1.25 cm (0.5 in.). The adaptor 21 is illustrated in FIG. 6*a* as being attached to the club head 23 with straps 26 which can be elastic or Velcro (trademark) type loop and hook straps. Alternatively, the adaptor 21 may be attached to the club face 22 by any other desired means, such as adhesive, two sided pressure sensitive adhesive removable tape, screws, especially the screws present in some club faces, clips or other means. Many golf clubs have groves in the face; the adaptor may be made with ridges on the back to mate with those groves, which will help hold the adaptor in the correct position. The back or base of the adaptor can be wider, to cover the entire face of the club head, or narrower, as desired.

It should be noted that since the practice balls of this invention are usually small and light weight, the adaptor usually need not be very strong structurally and the attachment means likewise need not be very strong. The most stress the adaptor and the attachment means will be subjected to is from the divot strokes and swings. If the attachment means and the adaptor itself do not extend below or to the underneath side of the club head, then they will avoid most of the divot-related stress. Also, if used in conjunction with the brush/bristle type of mat described above, the club head and adaptor assembly should encounter little if any stress on the attachment means.

The view shown in FIG. 6*b* is somewhat the view the golfer will have when looking at the club with the adaptor 21 affixed to it as he or she is preparing to hit a practice ball 27. It can be seen that the concept of this invention is carried out of this adaptor embodiment through hitting a small, light weight practice ball 27 with a small radius convex ball hitting surface area 25 on the face 22 of the club 23. As with the practice golf club of this invention described herein, the adaptor embodiment of this invention can have various shapes and the ball hitting surface can have various shapes, all in accordance with the disclosure of this invention and function of the ball hitting surface in combination with the light weight practice balls of this invention in order to carry out the purpose of this invention, namely improve the performance of golfers in their golf games.

This invention has been described herein in terms of concept, function and purpose and has been illustrated with certain embodiments thereof, which embodiments are not intended to limit in any way the scope of this invention, which is defined by the appended claims in light of the disclosed concept, function, purpose and benefits of this invention.

We claim:

1. A practice golf club comprising:

a shaft;

grip means at the upper portion of the shaft; and the lower end of the shaft comprises a surface area adapted for hitting a ball which area available for contacting the ball is no more than about 3.5 cm wide, wherein the weight and length of the practice golf club is comparable to a conventional golf club.

2. A practice golf club according to claim 1 wherein the width is no more than about 2 cm.

3. A practice golf club according to claim 2 wherein the width is no more than about 1.5 cm.

4. A practice golf club according to claim 3 wherein said surface area is convex.

5. A practice golf club according to claim 3 wherein said surface area is spherical.

6. A practice golf club according to claim 3 wherein said surface area is cylindrical.

7. A practice golf club according to claim 2 wherein said surface area is convex.

8. A practice golf club according to claim 2 wherein said surface area is spherical.

9. A practice golf club according to claim 2 wherein said surface area is cylindrical.

10. A practice golf club according to claim 1 wherein said surface area is convex.

11. A practice golf club according to claim 1 wherein said surface area is spherical.

12. A practice golf club according to claim 1 wherein said surface area is cylindrical.

13. A gold practice system comprising in combination a practice golf club and a practice ball wherein:

the weight and length of the practice golf club is comparable to a conventional golf club and comprises:

a shaft;

grip means at the upper portion of the shaft; and the lower end of the shaft comprises a surface area adapted for hitting a ball which area available for contacting the ball is no more than about 3.5 cm wide; and the practice ball has a diameter no more than about 4.3 cm and a weight no more than about 30 g.

14. A golf practice system according to claim 13 wherein the width of said surface area is no more than about 2 cm, the diameter is no more than about 3 cm and the weight is no more than about 20 g.

15. A golf practice system according to claim 14 wherein the width of said surface area is no more than about 1.5 cm, the diameter is no more than about 2.5 cm and the weight is no more than about 10 g.

16. A golf practice system according to claim 15 wherein said surface area is convex.

17. A golf practice system according to claim 15 wherein said surface area is cylindrical.

18. A golf practice system according to claim 11 wherein said surface area is convex.

19. A golf practice system according to claim 14 wherein said surface area is cylindrical.

20. A golf practice system according to claim 13 further comprises a net means for catching the ball.

21. A golf practice system according to claim 20 wherein said surface area is cylindrical.

22. A golf practice system according to claim 21 further comprising a mat means on which the ball is positioned for hitting with the club.

23. A golf practice system according to claim 13 further comprising a mat means on which the ball is positioned for hitting with the club.

24. A golf practice system according to claim 23 wherein said surface area is cylindrical.

25. A golf practice system according to claim 13 wherein said surface area is convex.

26. A golf practice system according to claim 13 wherein said surface area is cylindrical.

27. A kit of parts for a golf practice system comprising a practice golf club and a practice ball wherein: the weight and length of the practice golf club is comparable to a conventional golf club and comprises:

a shaft;

grip means at the upper portion of the shaft; and the lower end of the shaft comprises a surface area adapted for hitting a ball which area available for contacting the ball is no more than about 3.5 cm wide; and the practice ball has a diameter no more than about 4.3 cm and a weight no more than about 30 g.

28. A kit of parts according to claim 27 wherein the width of said surface area is no more than about 2 cm, the diameter is no more than about 3 cm and the weight is no more than about 20 g.

29. A kit of parts according to claim 18 wherein said surface area is convex.

30. A kit of parts according to claim 27 wherein the width of said surface area is no more than about 1.5 cm, the diameter is no more than about 2.5 cm and the weight is no more than about 10 g.

31. A kit of parts according to claim 30 wherein said surface area is convex.

32. A kit of parts according to claim 30 wherein said surface area is cylindrical.

33. A kit of parts according to claim 28 wherein said surface area is cylindrical.

34. A kit of parts according to claim 27 further comprising a net means for catching the ball.

35. A kit of parts according to claim 34 wherein said surface area is cylindrical.

36. A kit of parts according to claim 35 further comprising a mat means on which the ball is positioned for hitting with the club.

37. A kit of parts according to claim 27 further comprising a mat means on which the ball is positioned for hitting with the club.

38. A kit of parts according to claim 37 wherein said surface area is cylindrical.

39. A kit of parts according to claim 27 wherein said surface area is convex.

40. A kit of parts according to claim 21 wherein said surface area is cylindrical.

41. A method of practicing golf to improve a player's game performance comprising the player hitting a practice ball having a diameter of no more than about 4.3 cm and a weight of no more than about 30 g with a practice club comprising a shaft, grip means at the upper portion of the shaft, and the lower end of the shaft comprises a surface area adapted for hitting a ball which area available for contacting the ball is no more than about 3.5 cm wide, wherein the weight and length of the practice golf club is comparable to a conventional golf club.

42. A method according to claim 41 wherein the width of said surface area is no more than about 2 cm, the diameter of said ball is no more than about 3 cm and the weight of said ball is no more than about 20 g.

43. A method according to claim 42 wherein the width of said surface area is no more than about 1.5 cm, the diameter is no more than about 2.5 cm and the weight is no more than about 10 g.

44. A method according to claim 41 further comprising hitting the ball into a net means for catching the ball.

45. A method according to claim 44 further comprising hitting the ball off of a mat means on which the ball is positioned for hitting with the club.

46. A method according to claim 41 further comprising hitting the ball off of a mat means on which the ball is positioned for hitting with the club.

* * * * *